US010808420B2

(12) United States Patent
Morstatt et al.

(10) Patent No.: US 10,808,420 B2
(45) Date of Patent: Oct. 20, 2020

(54) CHANNEL GASKET AND PLUG FOR ELECTROMECHANICAL LOCK

(71) Applicant: Yale Security Inc., New Haven, CT (US)

(72) Inventors: Scott Morstatt, Maryville, TN (US); Wai P. Wong, Orange, CT (US); Craig Babcock, Cheshire, CT (US); Mark Caterino, Prospect, CT (US)

(73) Assignee: Yale Security Inc., New Haven, CT (US)

( * ) Notice: Subject to any disclaimer, the term of this patent is extended or adjusted under 35 U.S.C. 154(b) by 517 days.

(21) Appl. No.: 15/797,184

(22) Filed: Oct. 30, 2017

(65) Prior Publication Data

US 2018/0119449 A1 May 3, 2018

Related U.S. Application Data

(60) Provisional application No. 62/415,126, filed on Oct. 31, 2016.

(51) Int. Cl.

| | |
|---|---|
| ***E05B 17/00*** | (2006.01) |
| ***E05B 9/08*** | (2006.01) |
| *E05B 9/02* | (2006.01) |
| *E05B 47/00* | (2006.01) |

(52) U.S. Cl.

CPC ..... *E05B 17/002* (2013.01); *E05B 9/08* (2013.01); *E05B 9/02* (2013.01); *E05B 2047/0058* (2013.01)

(58) Field of Classification Search

CPC .. E05B 17/002; E05B 9/08; E05B 2047/0058; E05B 9/02; E05B 77/34

USPC ..... 70/277, 278.1, 278.7, 279.1, 280–283; 292/144

See application file for complete search history.

(56) References Cited

U.S. PATENT DOCUMENTS 6,877,346 B1 * 4/2005 Finkelstein ..... E05B 17/0075 292/92
8,490,445 B2 * 7/2013 Chiou ..... E05B 47/0012 70/279.1

(Continued)

FOREIGN PATENT DOCUMENTS

| | | |
|---|---|---|
| KR | 20110109161 A | 10/2011 |
| KR | 101381039 B1 | 4/2014 |
| WO | 2014064992 A1 | 5/2014 |

*Primary Examiner* — Lloyd A Gall

(74) *Attorney, Agent, or Firm* — Delio Peterson & Curcio; Peter W. Peterson

(57) ABSTRACT

An electronic lock housing for the inside surface of a door with an opening therethrough has an interior portion for receiving electronic components for a door lock, a back portion with channels, a bracket, a plug, and a front portion. The back portion is meant for securing onto the door surface and has an opening meant for alignment with the door opening. The channels in the back portion permit air from the outside of the door to flow through the door opening and housing back opening to the inside of the door without passing through the housing interior. The bracket secures the back portion to the door and receives the plug to create an air-tight seal within the housing interior. The housing front portion is secured over the assembled back portion, bracket, and plug once they are installed to the door surface, fully encasing the electronic components.

24 Claims, 15 Drawing Sheets

(56) References Cited

U.S. PATENT DOCUMENTS

2006/0279095 A1* 12/2006 Ishiguro ..... E05B 81/76
292/336.3
2010/0269554 A1* 10/2010 Mak ..... E05B 1/0015
70/91
2015/0308157 A1* 10/2015 Lin ..... E05B 47/026
292/144

* cited by examiner

CHANNEL GASKET AND PLUG FOR ELECTROMECHANICAL LOCK

BACKGROUND OF THE INVENTION

1. Field of the Invention

The present invention relates to electromechanical locks and, in particular, to an apparatus and methods to reduce condensation problems experienced within electromechanical locks.

2. Description of Related Art

It has been determined that condensation is a major cause of failures in electromechanical locks in certain geographic areas which experience high humidity. Coatings are required to protect electronic components in electromechanical locks, which add significant manufacturing costs.

SUMMARY OF THE INVENTION

Bearing in mind the problems and deficiencies of the prior art, it is therefore an object of the present invention to provide an apparatus and methods to reduce condensation problems experienced on electromechanical locks.

Still other objects and advantages of the invention will in part be obvious and will in part be apparent from the specification.

The above and other objects, which will be apparent to those skilled in the art, are achieved in the present invention which is directed to an electronic lock housing for an inside of a door having an opening therethrough for passage of a drive bar from the electronic lock housing to a lock on the door. The electronic lock housing comprises a housing interior portion for receiving electronic components for the door lock, a housing back portion, and one or more channels in the housing back portion. The housing back portion has a back opening for securing on the inside of the door over the door opening, the housing back opening being between the housing interior portion and the door. The one or more channels in the housing back portion extend between the housing back opening and an exterior of the housing, to permit air from the outside of the door to flow through the door opening and the housing back opening to the inside of the door, without passing through the housing interior portion.

In an embodiment, the electronic lock housing back portion comprises a gasket between the door and the housing, and the one or more channels are disposed in the housing back portion gasket. The one or more channels may comprise slots in the housing back portion. The housing back portion may also comprise a gasket between the door and the housing, and the one or more channels may comprise slots in the housing back portion gasket. The electronic lock housing may further include a plug aligned with the housing back opening for restricting flow of air from the outside of the door through the door opening and into the housing interior portion. The plug may include an opening for passage of the drive bar from the housing interior portion to the door lock and, optionally, an opening for a cable from the housing interior portion to the door lock. The plug opening may be configured to mate with a collar around the drive bar in the housing interior portion. The electronic lock housing may further include one or more secondary channels in the housing back portion to permit air from the inside of the door to flow into the housing interior portion. The one or more secondary channels may also comprise slots in the housing back portion. The housing back portion may further comprise a gasket between the door and the housing, and the one or more secondary channels may comprise slots in the housing back portion gasket to permit air from the inside of the door to flow into the housing interior portion.

The present invention may further be directed to an electronic lock housing for an inside of a door having an opening therethrough for passage of a drive bar from the electronic lock housing to a lock on the door. The electronic lock housing comprises a housing interior portion for receiving electronic components for the door lock, a housing back portion, and a plug aligned with the housing back opening. The housing back portion has a back opening for securing on the inside of the door over the door opening, the housing back opening being between the housing interior portion and the door. The plug aligned with the housing back opening restricts flow of air from the outside of the door through the door opening and into the housing interior portion.

The present invention may also be directed to an electronic lock housing for an inside of a door having an opening therethrough for passage of a drive bar from the electronic lock housing to a lock on the door. The electronic lock housing comprises a housing interior portion for receiving electronic components for the door lock, a housing back portion, and one or more secondary channels in the housing back portion. The housing back portion is for securing on the inside of the door over the door opening. The one or more secondary channels in the housing back portion permit air from the inside of the door to flow into the housing interior portion.

The present invention may still further be directed to a method of sealing an electronic lock housing for a door. The method provides an electronic lock housing having a housing interior portion for receiving electronic components for a door lock, a housing back portion having a back opening for securing on the inside of a door over a door opening, and the housing back opening having one or more channels extending between the housing back opening and an exterior of the housing. The method includes mounting the electronic lock housing with the housing back portion on the inside of the door and over the door opening, and permitting air from the outside of the door to flow through the door opening, the housing back opening, and the one or more channels to the inside of the door, without passing through the housing interior portion.

In an embodiment, the method may further include aligning a plug with the housing back opening of the electronic lock housing to restrict flow of air from the outside of the door through the door opening and into the housing interior portion. The method may also provide in the electronic lock housing one or more secondary channels in the housing back portion to permit air from the inside of the door to flow into the housing interior portion. The method may still further include the door opening permitting passage of a drive bar from the electronic lock housing to a lock on the door, and wherein the method reduces condensation of humid outside air in the electronic housing.

The present invention may also be directed to a method of sealing an electronic lock housing for a door. The method provides an electronic lock housing having a housing interior portion for receiving electronic components for a door lock, a housing back portion having a back opening for securing on the inside of the door over a door opening, the housing back opening being between the housing interior portion and the door, and a plug aligned with the housing back opening. The method includes the steps of mounting the electronic lock housing with the housing back portion on the inside of the door and over the door opening, and restricting the flow of air from the outside of the door through the door opening by the plug aligned with the housing back opening.

In an embodiment, the method further provides in the electronic lock housing interior portion one or more channels extending between the housing back opening and an exterior of the housing, the one or more channels permitting air from the outside of the door to flow through the door opening, the housing back opening, and the one or more channels to the inside of the door, without passing through the housing interior portion. The method may further include providing one or more secondary channels in the housing back portion to permit air from the inside of the door to flow into the housing interior portion. The door opening may also permit passage of a drive bar from the electronic lock housing to a lock on the door, and the method may reduce condensation of humid outside air in the electronic lock housing.

The present invention may still further be directed to a method of sealing an electronic lock housing for a door. The method provides an electronic lock housing having a housing interior portion for receiving electronic components for a door lock, and a housing back portion having a back opening for securing on the inside of the door over a door opening. The housing back opening is between the housing interior portion and the door, and one or more secondary channels are in the housing back portion to permit air from the inside of the door to flow into the housing interior portion. The method includes mounting the electronic lock housing with the housing back portion on the inside of the door and over the door opening, and permitting air from the inside of the door to flow into the housing interior portion.

In an embodiment, the method further provides in the electronic lock housing interior portion one or more channels extending between the housing back opening and an exterior of the housing. The one or more channels may permit air from the outside of the door to flow through the door opening, the housing back opening, and the one or more channels to the inside of the door, without passing through the housing interior portion. The method may still further include aligning a plug with the housing back opening to restrict the flow of air from the outside of the door through the door opening and into the housing interior portion. The door opening may also permit passage of a drive bar from the electronic lock housing to a lock on the door, and the method may further include reduce condensation of humid outside air in the electronic lock housing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment(s) of the present invention, reference will be made herein to FIGS. 1-15 of the drawings in which like numerals refer to like features of the invention.

The present invention is directed to an improved housing for an electromechanical lock on a door that limits access from an outside humid area to an inside room. As used herein, the outside of the door shall mean the (humid) space adjacent the surface of the door on the outside of the room, and the inside of the door shall mean the space adjacent the opposite surface of the door on the inside of the room. Furthermore, and for purposes of this application, the term "fastener" may refer, but not be limited to: screws, nails, rivets, or dowels.

Figure 1:
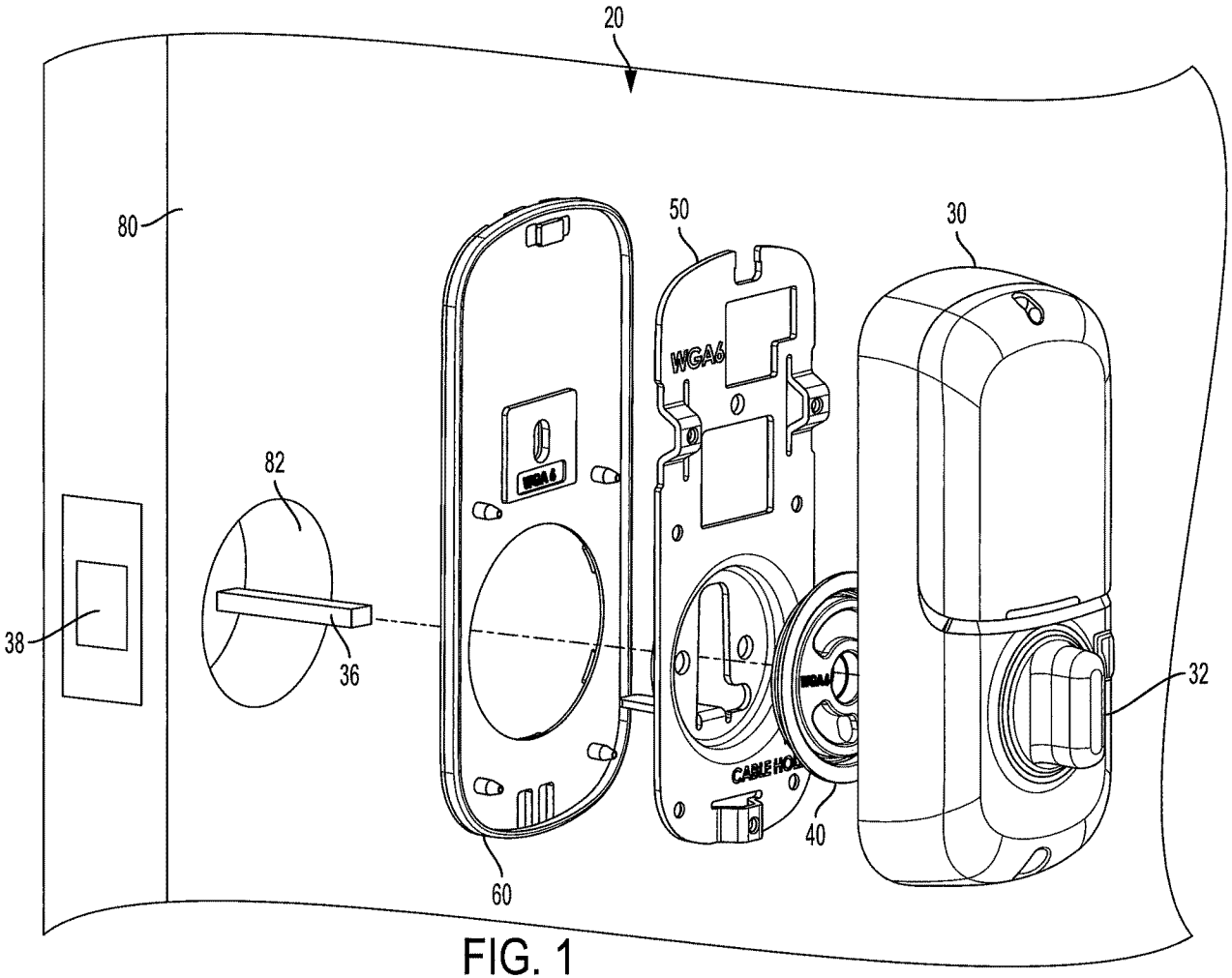
FIG. 1 is a front perspective exploded view of the electronic lock housing of the present invention, including the housing back portion and the sealing plug, for mounting on the inside surface of a door over a through hole containing a deadbolt mechanism.

Referring to FIG. 1, an electronic lock housing 20 is constructed in accordance with the present invention to mount to an inside surface of a door 80 to control operation of a deadbolt 38 or other lock mechanism via opening 82 through the door. Opening 82 permits passage of a drive bar 36 extending through collar 34 from the back of housing 20 and is operable by pivoting rotation of a thumbturn 32 to operate the lock via an otherwise conventional drive mechanism (FIG. 2).

Figure 10:
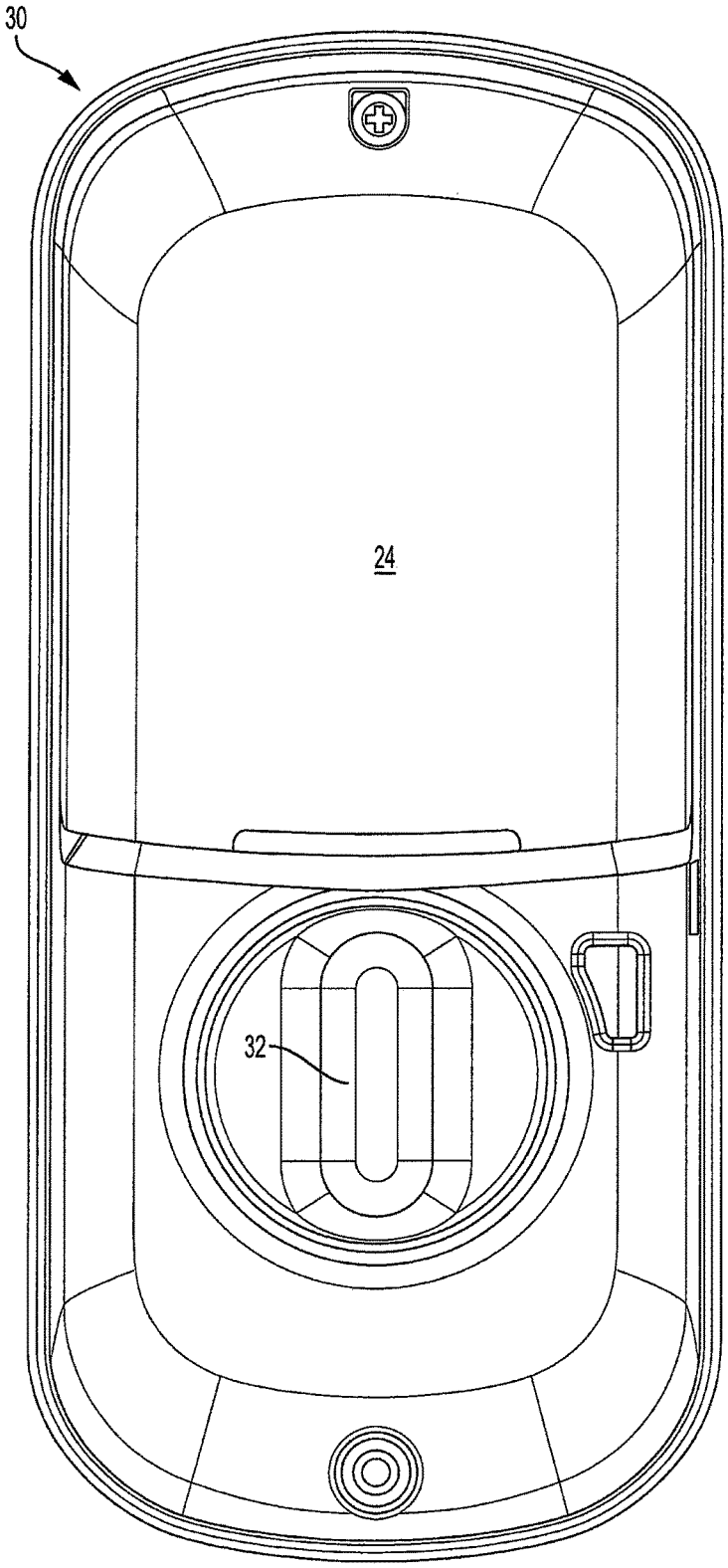
FIG. 10 is a frontal view of the electronic lock housing of FIG. 1.
Figure 11:
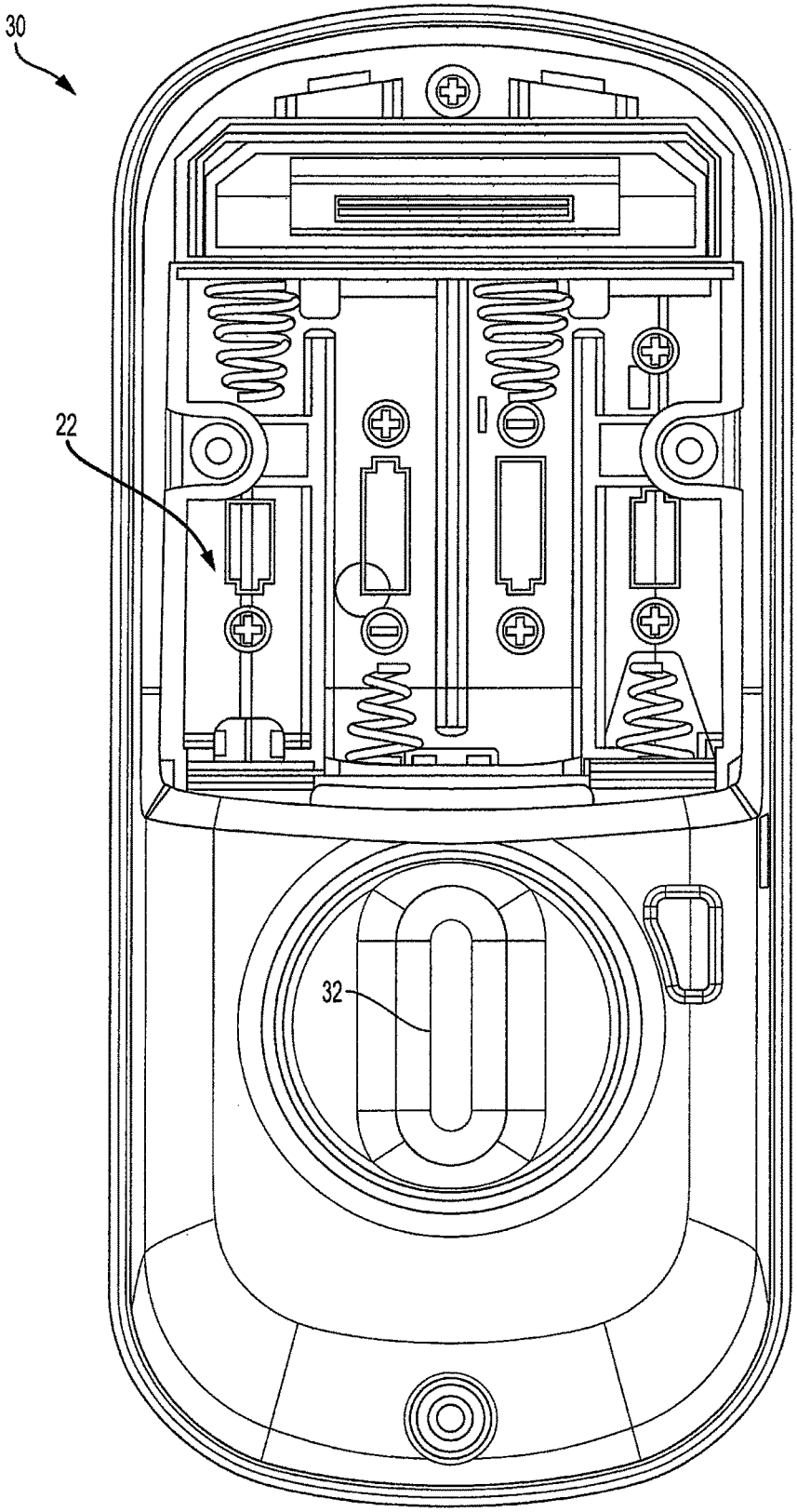
FIG. 11 is a frontal view of the electronic lock housing of FIG. 1 without a cover on the housing front portion.

Referring to FIGS. 10-11, lock housing 20 has a front portion 30 comprising the thumbturn 32 and a battery holder 22 for receiving batteries 23 (not shown), the batteries 23 which provide the electrical energy needed to operate the mechanical and electrical components within lock housing 20. As shown in FIG. 10, the battery holder 22 is encased by a removable shell 24 that may be secured over the battery holder 22 and held in place with fasteners, adhesives, or a tongue-and-groove configuration between the outer edges of the shell 24 and outer edges of the housing front portion 30, to create an air-tight seal protecting the batteries 23 from the surrounding outside elements.

Figure 2:
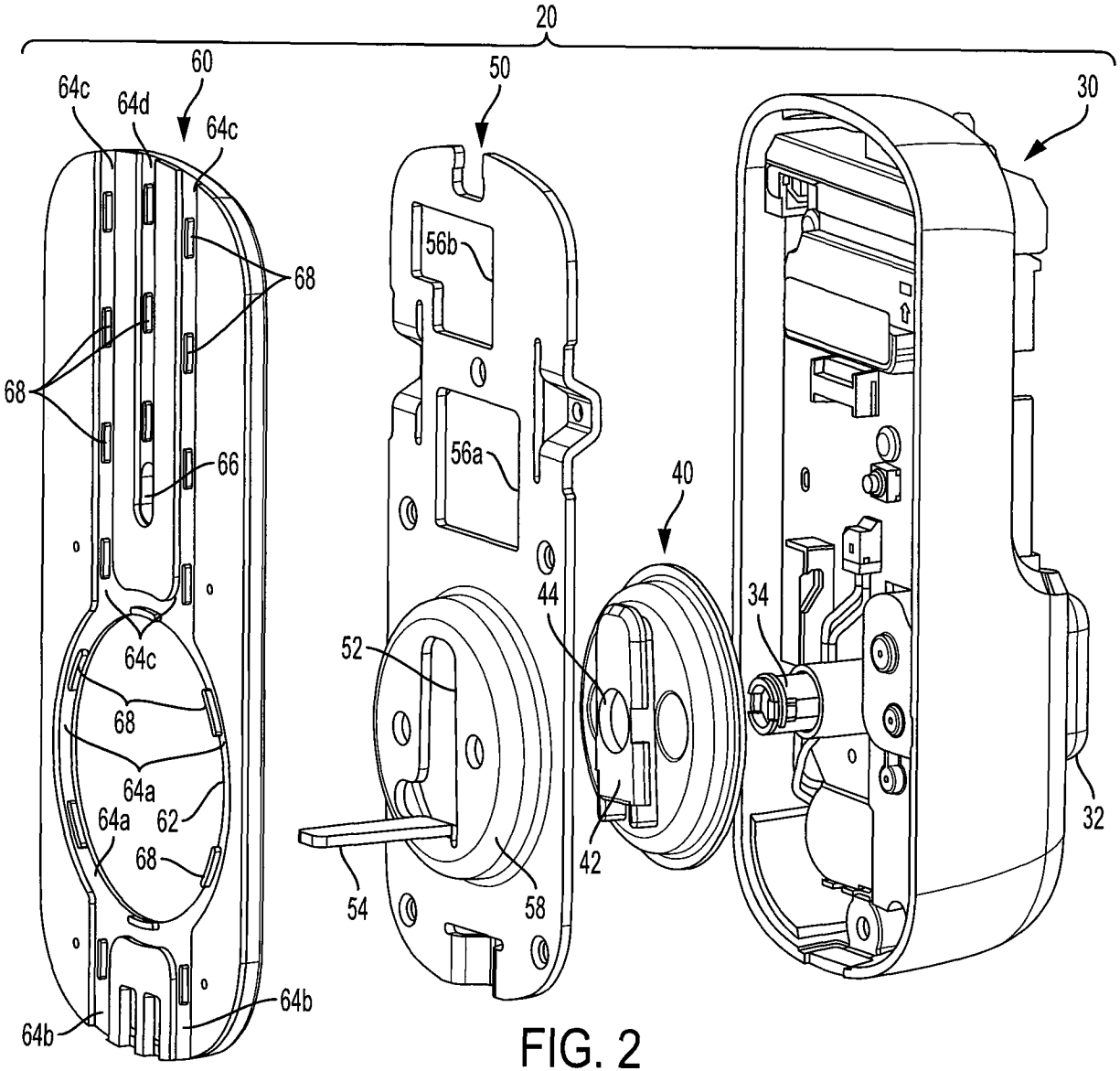
FIG. 2 is a rear perspective exploded view of the electronic lock housing of FIG. 1.
Figure 8:
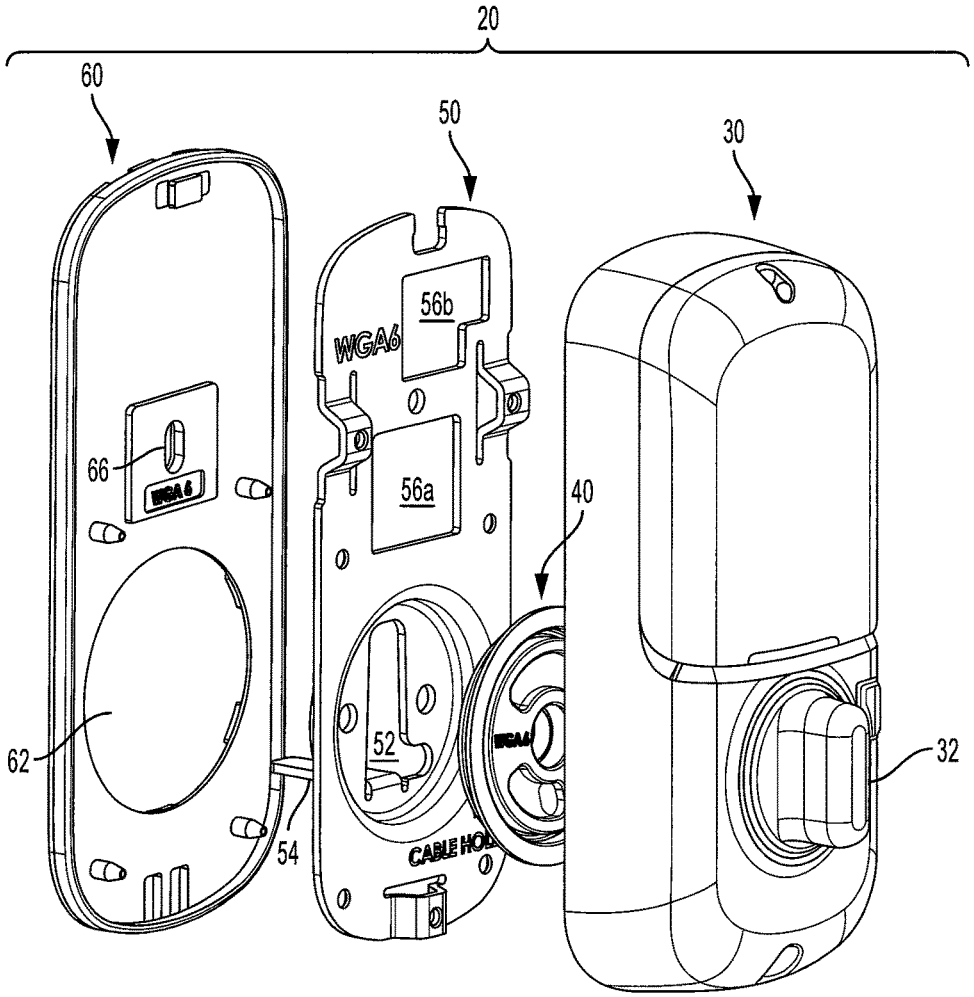
FIG. 8 is a front perspective exploded view of the electronic lock housing of FIG. 1.
Figure 9:
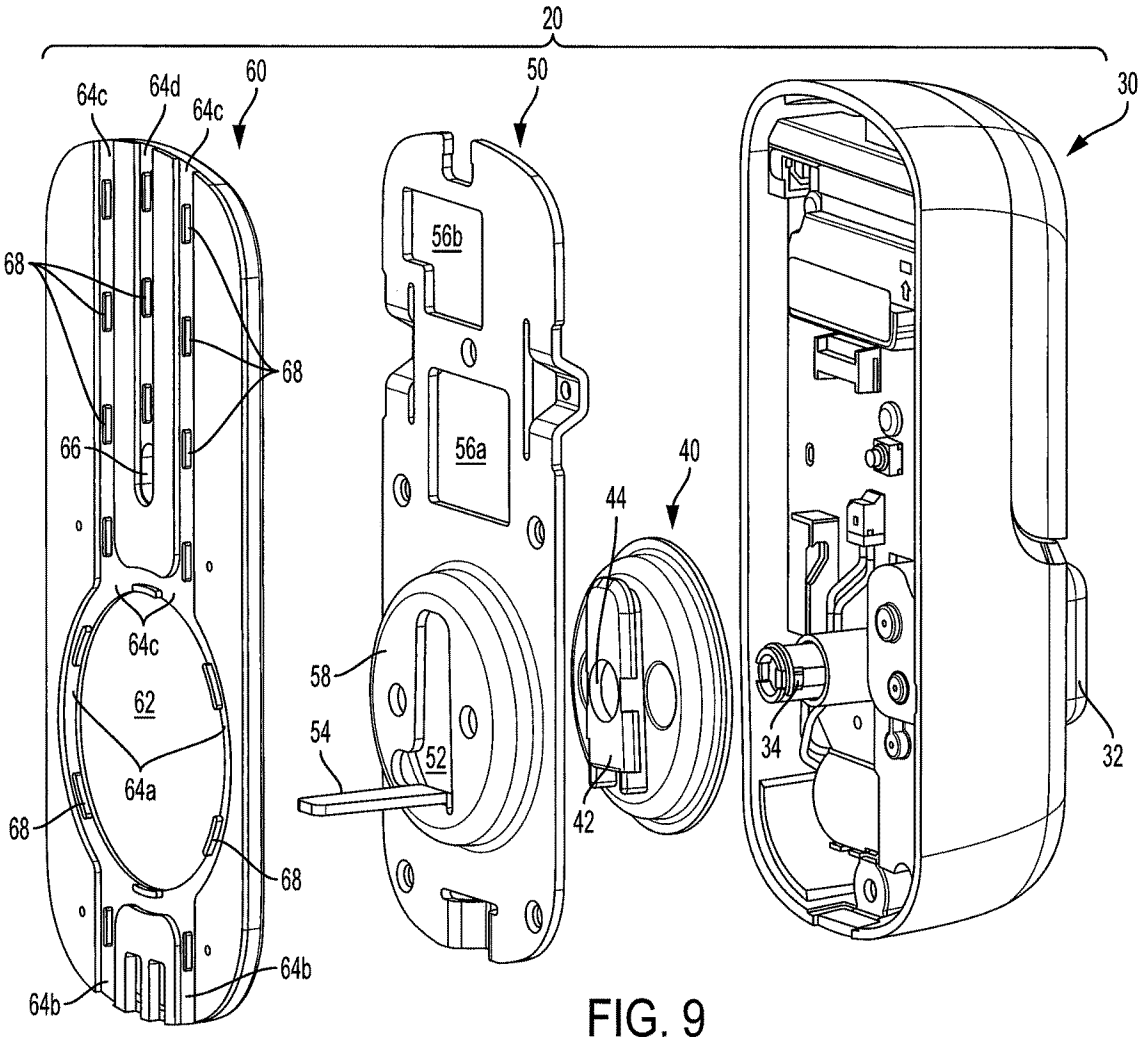
FIG. 9 is a rear perspective exploded view of the electronic lock housing of FIG. 2 including a cover disposed on the housing front portion.

As shown in FIG. 2, a conventional bracket 50 may be secured to the inside door surface using fasteners. The bracket 50 includes a circular rearward protuberance 58 conforming to the door opening 82, and a rearwardly protruding arm 54 for engaging the door lock mechanism. Openings 52, 56*a*, 56*b* are provided, the former opening 52 which is disposed in protuberance 58 to allow for passage of the drive bar 36 (FIGS. 1 and 8-9). Opening 56*a* is disposed within the center of bracket 50 to allow for air flow to escape from the inside of lock front housing 30, through bracket 50 opening 56*a*, and through a vent 66 (discussed in greater detail below). Opening 56*b* is disposed near the top-center portion of bracket 50. Front housing portion 30 is secured to the bracket with fasteners and/or clips to hold the lock housing 20 and interior components in place.

Figure 4:
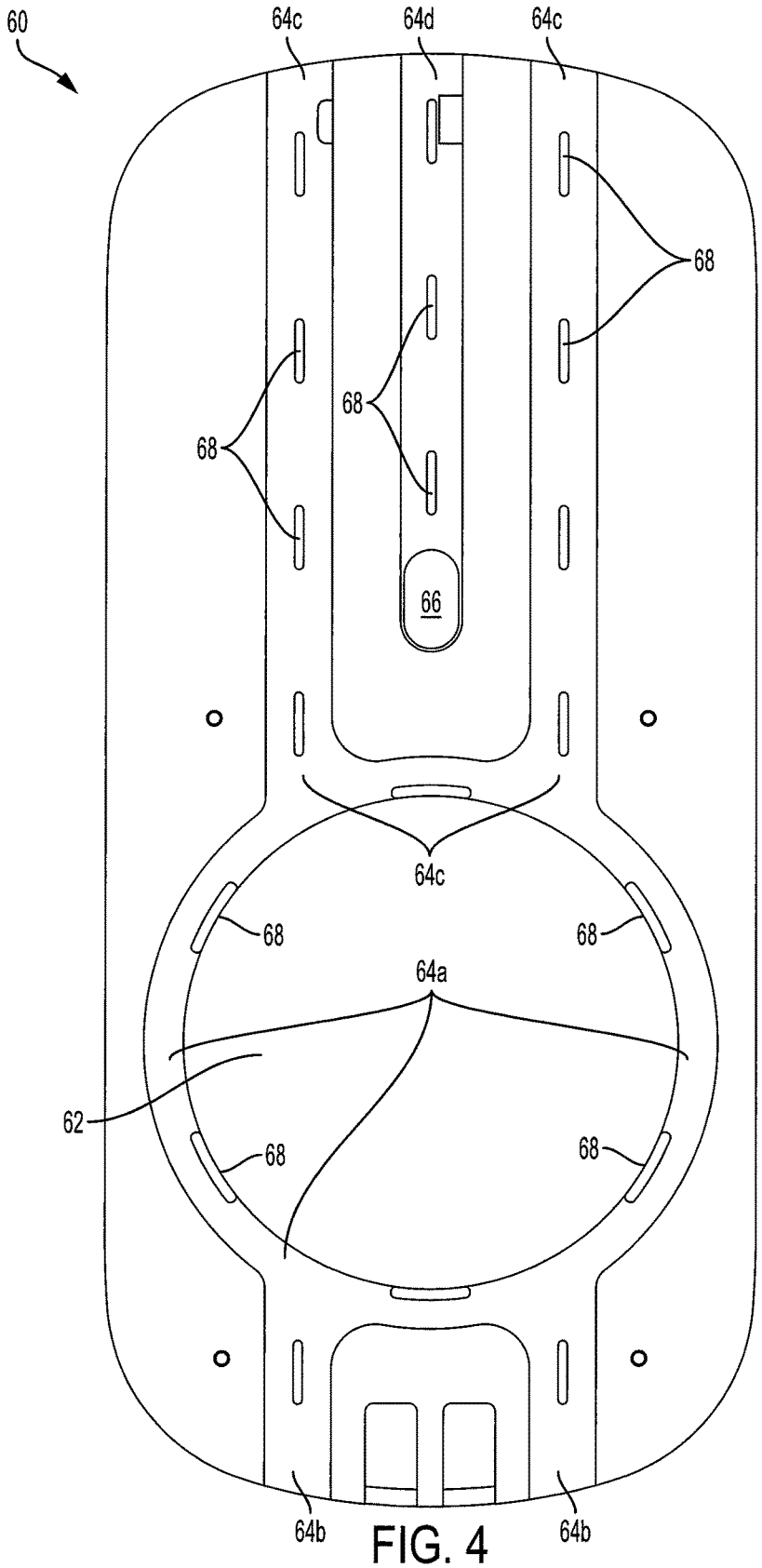
FIG. 4 is a rear elevational view of the rear portion of the electric lock housing of FIG. 1.
Figure 5:
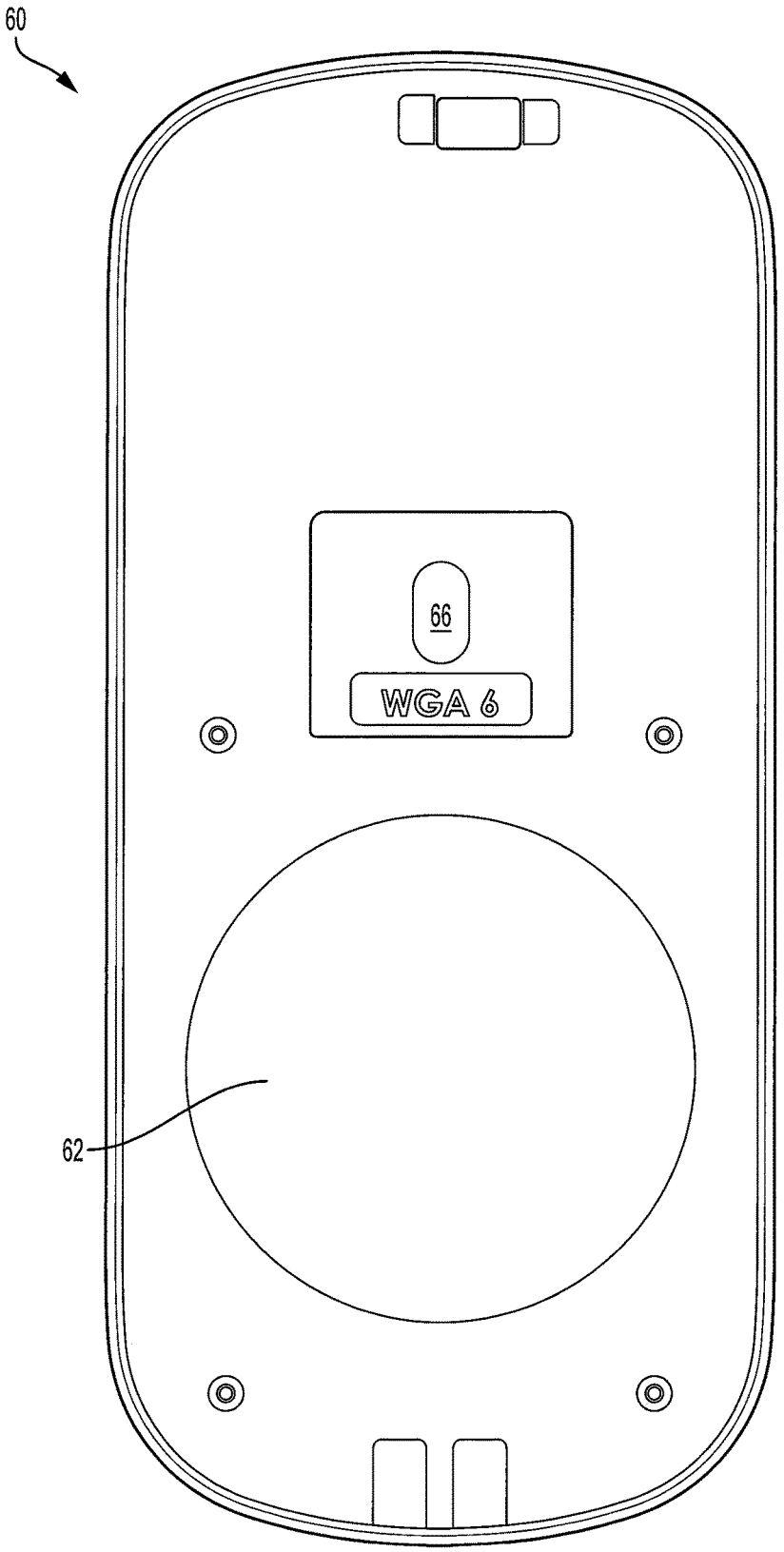
FIG. 5 is a front elevational view of the rear portion of the electric lock housing of FIG. 4.

Between bracket 50 and the door 80 is a housing back portion 60 comprising a flat back plate or gasket (FIGS. 4-5). Back portion 60 may be a separate piece made of, for example, but not limited to, a polymer or metal, or may be integral and of one piece with front housing 30 and/or bracket 50. Openings are provided for receiving the same fasteners meant for securing bracket 50 to the door. Back portion 60 is of comparable configuration to front housing 30 and includes a central opening 62 that when mounted on the door corresponds in location to door drive bar opening 82. Back portion 60 mounts flush to the surface of the door 80 on the inside of the room.

Figure 12:
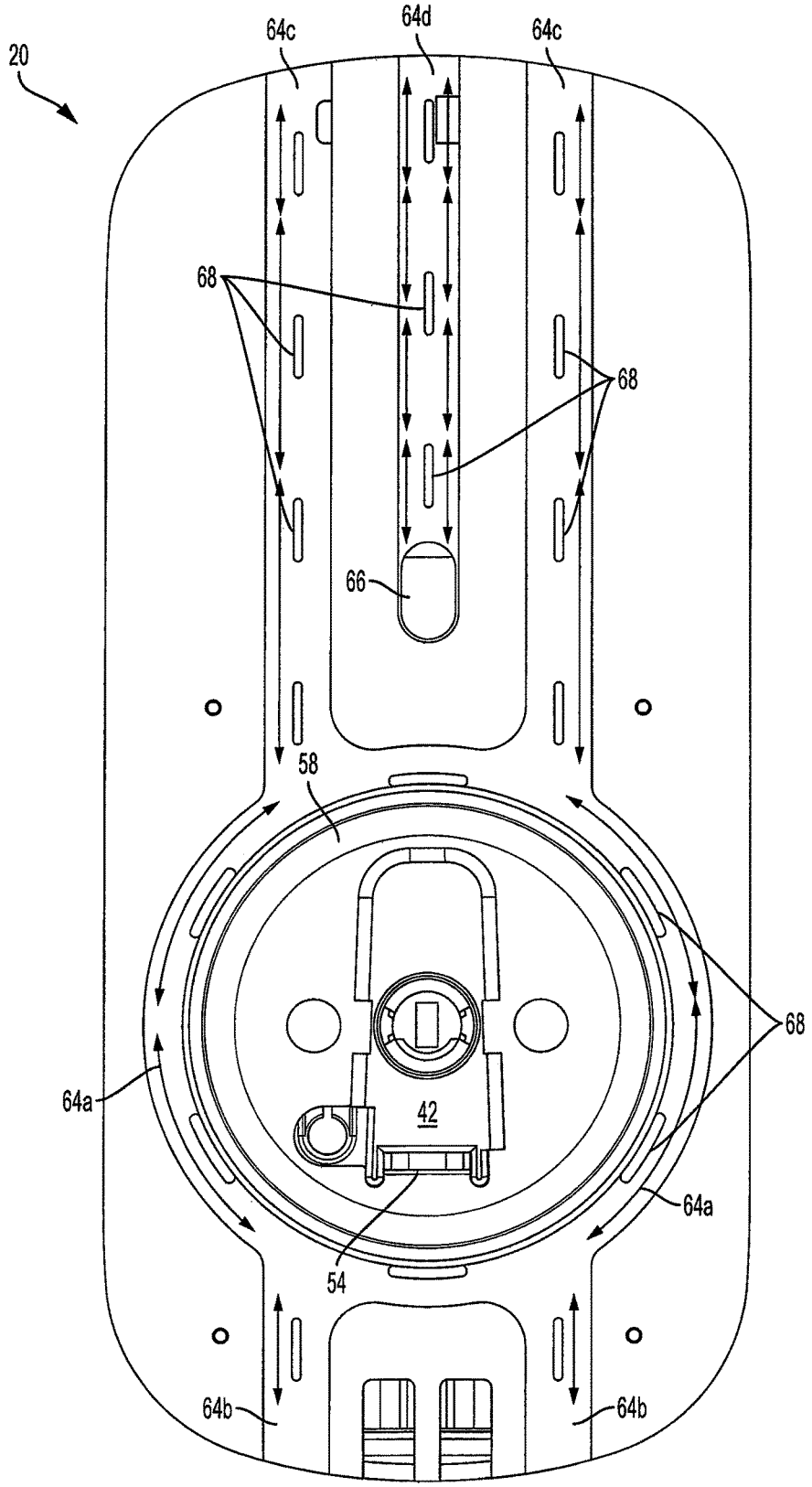
FIG. 12 is a rear view of the electronic lock housing of FIG. 1.
Figure 13:
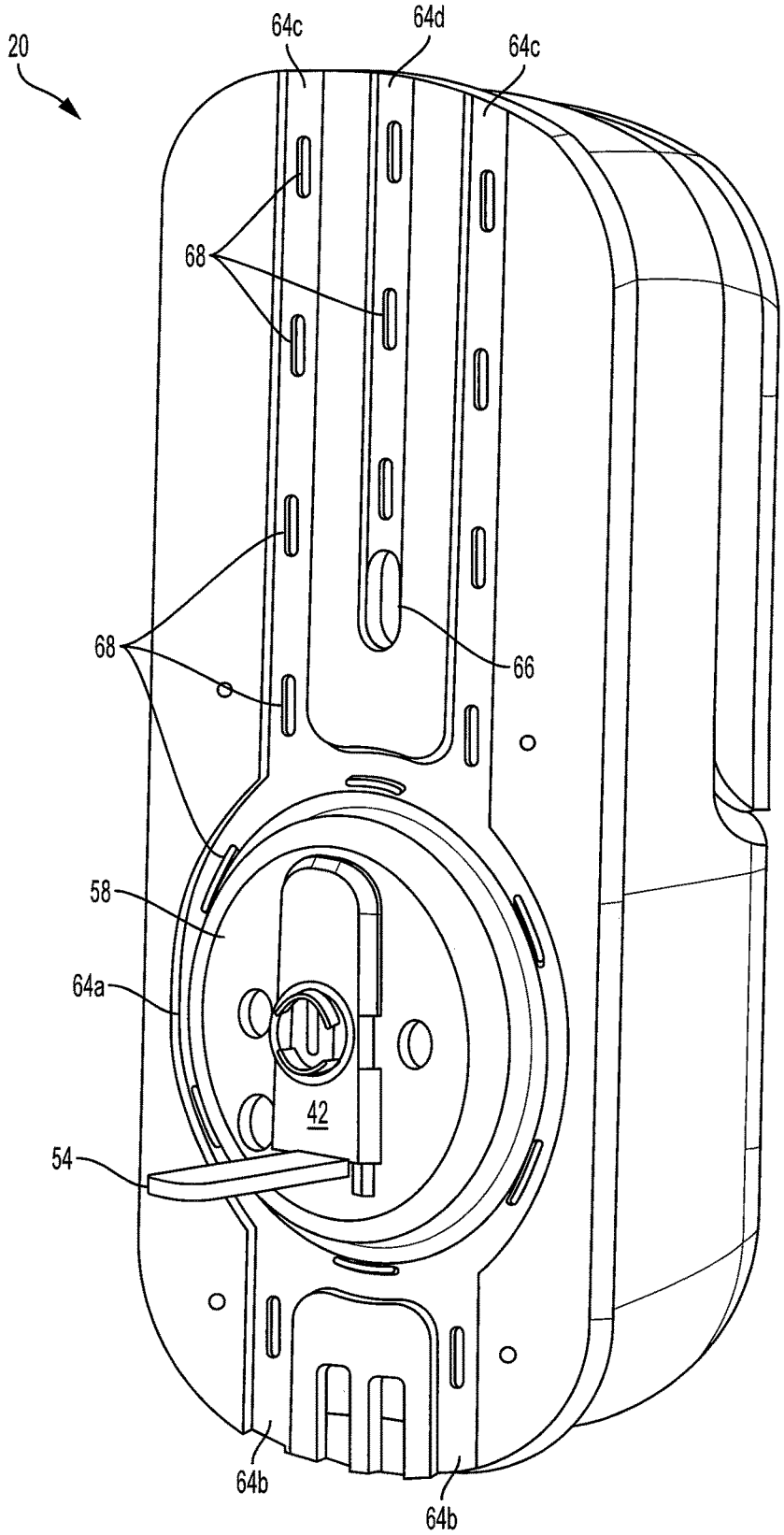
FIG. 13 is a rear perspective view of the electronic lock housing of FIG. 1.

Referring now to FIG. 4, one or more primary channels 64*a*-64*c* are provided in the door-facing surface of back portion 60, adjacent to the door surface when mounted. As shown in FIGS. 4 and 12, the primary channels 64*a*-64*c* may be open slots that are molded or otherwise formed in the back portion 60 surface extending between back portion central opening 62 and an exterior of housing 20 to permit air from the outside of the door 80 to flow through the door opening 82 and the housing 20 back central opening 62 to the inside of the door (as depicted by the arrows within channels 64*a*-64*c* in FIG. 12), without passing through the interior portion of front housing 30. As an alternative, the channels 64*a*-64*c* may have closed surfaces and extend within back portion 60. These primary channels may include peripheral channel 64*a* extending around the perimeter of central opening 62, and pairs of spaced parallel channels 64*b* and 64*c* extending therefrom downward and upward, respectively. The ends of channels 64*b* and 64*c* distal from opening 62 are exposed and open to the room on the inside of the door 80 when housing front portion 30 is secured in place for operation.

There may further be provided in back portion 60 one or more secondary channels 64*d* to permit air from the room on the inside of the door 80 to flow into the housing 30 interior portion (FIG. 12). These secondary channels 64*d* may also be similarly formed as open slots or as enclosed channels 64*d* molded or otherwise formed in the rear surface of back portion 60. The upper end of channel 64*d* distal from vent 66 is again open to the room inside the door 80, and the lower end connects with vent 66 through the central portion of back portion 60. This allows air to flow from the inside of front housing 30, through bracket opening 56*a*, through vent 66, up and through channel 64*d* to the room on the inside of the door 80, and vice versa (the air flow as depicted by the arrows within channel 64*d* in FIG. 12).

The open slot embodiments of primary and secondary channels 64*a*-64*d* may include spaced projections 68 therein, the projections 68 being of smaller dimensions than their respective slot widths, to prevent the slots 64*a*-64*d* from collapsing and preventing air flow when secured to the door 80. This ensures that air may flow freely from the outside of the door 80 to the room on the inside of the door (channels 64*a, b, c*), from the lock housing 30 interior to the room inside the door (channel 64*d*), and from the room inside of the door 80 to the lock housing 30 interior (channel 64*d*).

Figure 3:
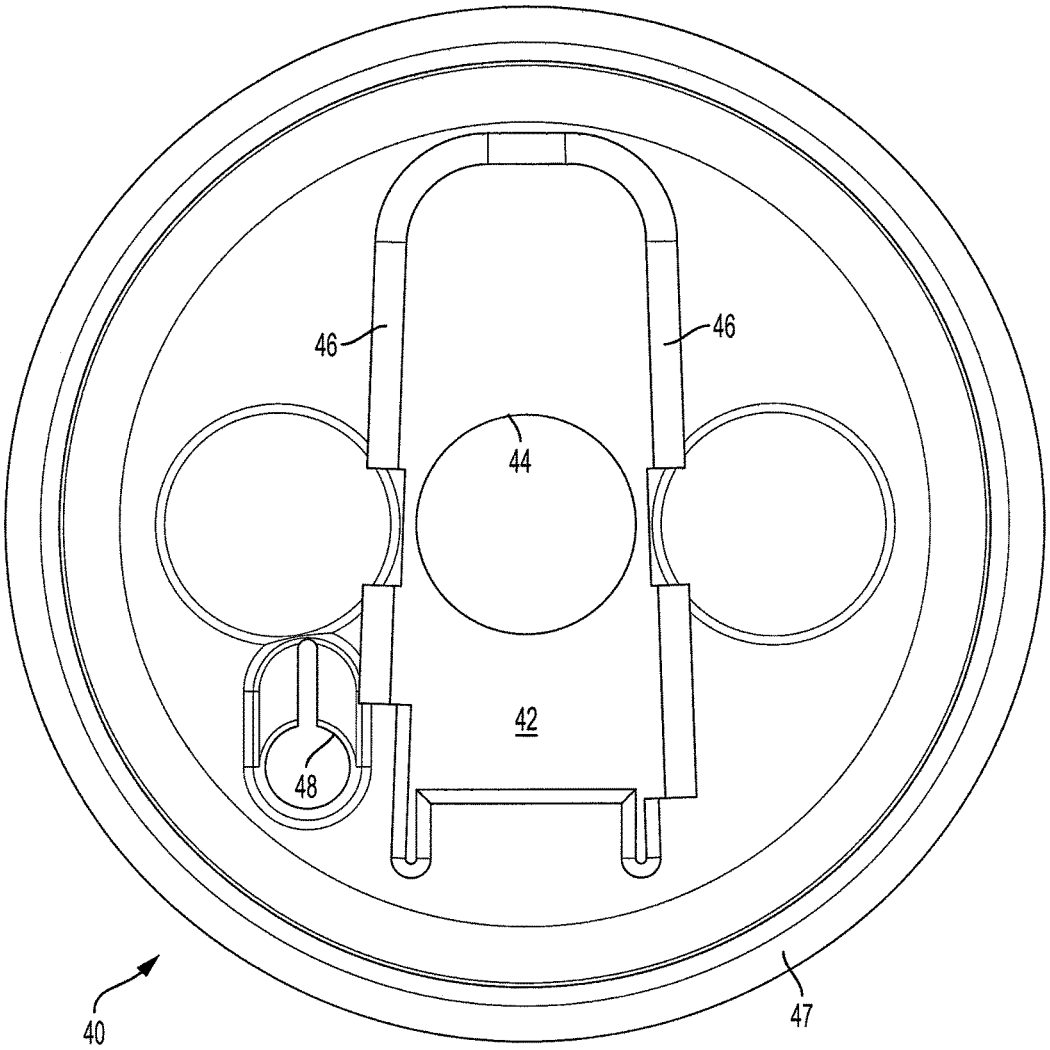
FIG. 3 is a rear elevational view of the sealing plug used in the electronic lock housing of FIG. 1.
Figure 6:
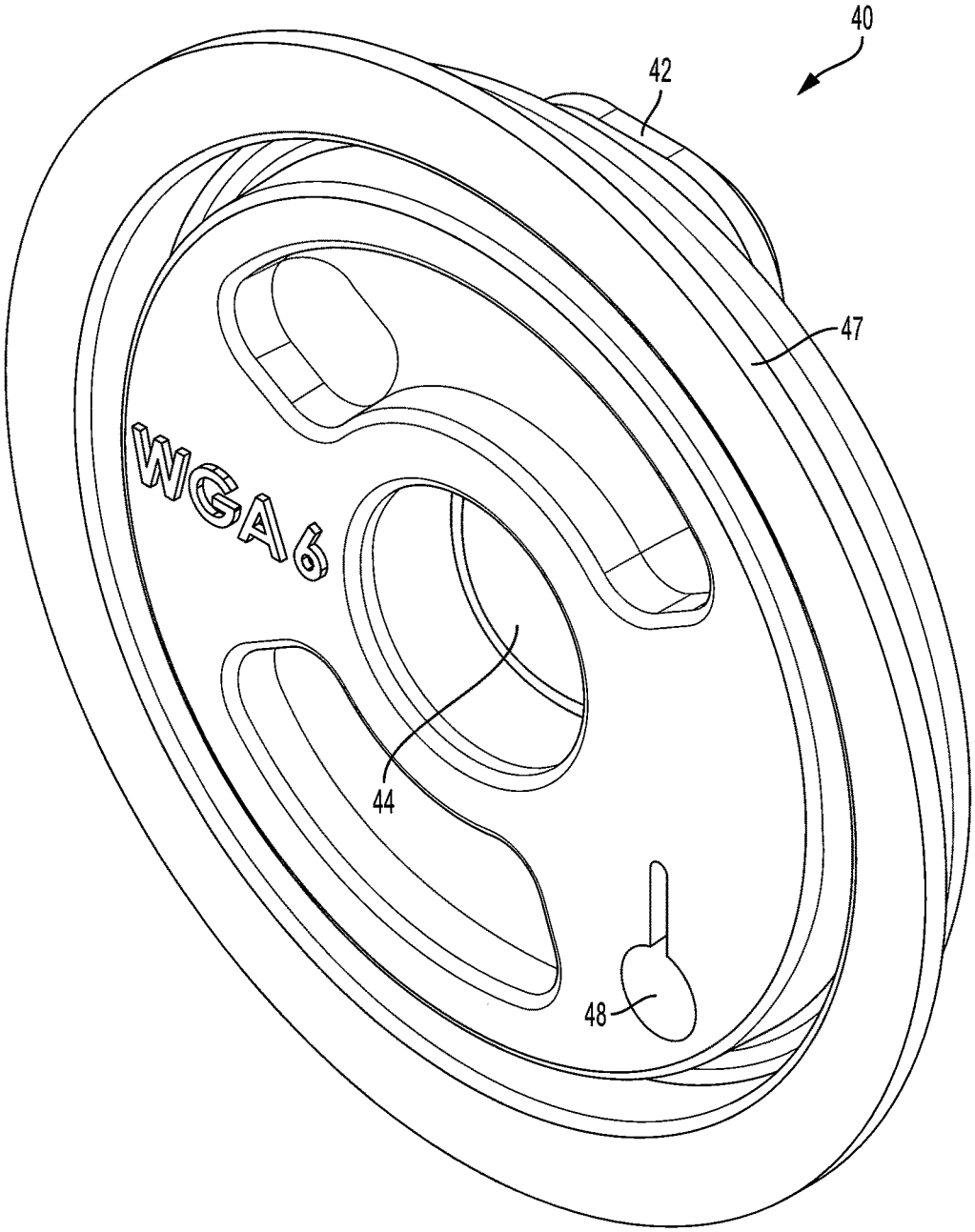
FIG. 6 is a perspective view of the sealing plug of FIG. 3.
Figure 7:
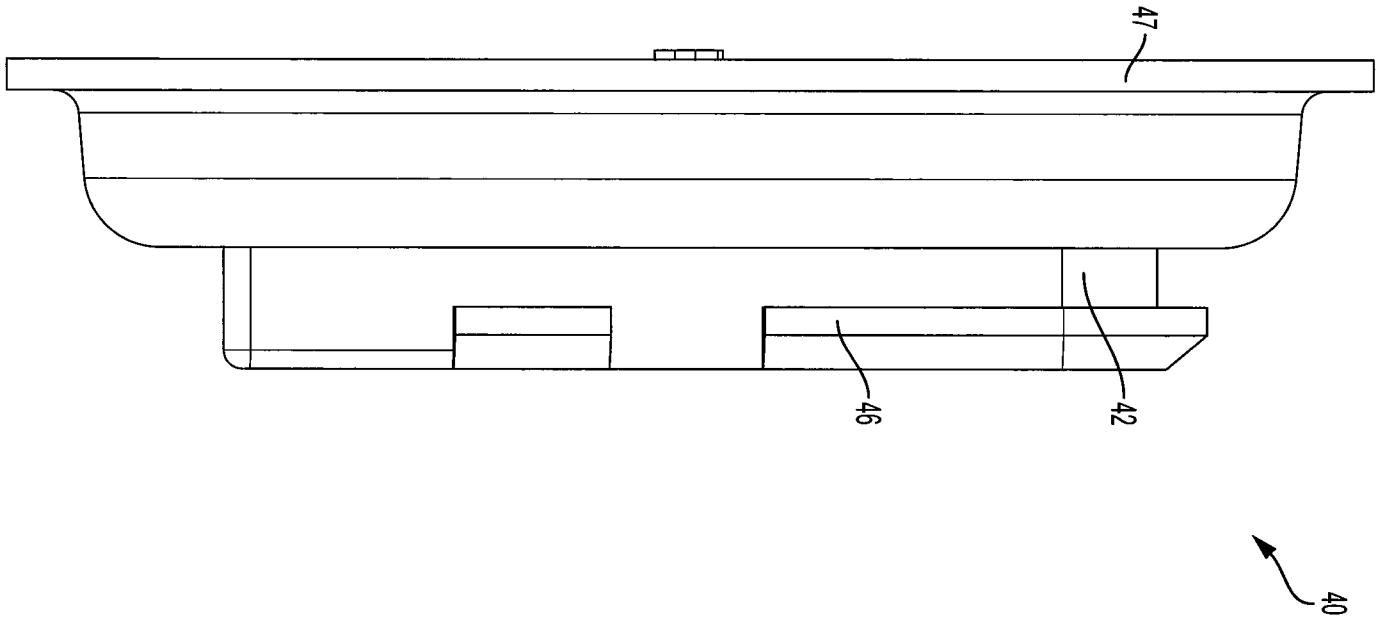
FIG. 7 is a side view of the sealing plug of FIG. 3.

To provide further sealing of air flow the electronic lock housing 20 further includes a plug 40 disposed between the housing front portion 30 and bracket 50. After installation, plug 40 is aligned with housing back central opening 62 and mates with protuberance 58 (FIG. 9). Plug 40 may be made of, but not limited to, a flexible polymer such as silicone rubber. Plug 40 comprises a central rearward projection 42 configured to mate with bracket opening 52, and has a central opening 44 for passage of the drive bar 36 from the housing interior portion to the door lock (FIG. 3). Plug opening 44 is configured to mate with the collar 34 around the drive bar 36 in the housing 30 interior portion. A secondary plug opening 48 permits passage of an electrical cable (not shown) from the housing 20 interior portion to the door lock. After projection 42 has been pushed into and through bracket opening 52, one or more flexible tabs 46 along the periphery of the projection 42 bear against the edge of the bracket opening 52 to secure the plug 40 in place (FIGS. 6-7). Outwardly extending flange 47 seals against the periphery of protuberance 58. Plug 40 serves to restrict flow of air from the outside of the door 80 through the door opening 82 and into the front housing 30 interior portion.

Figure 14:
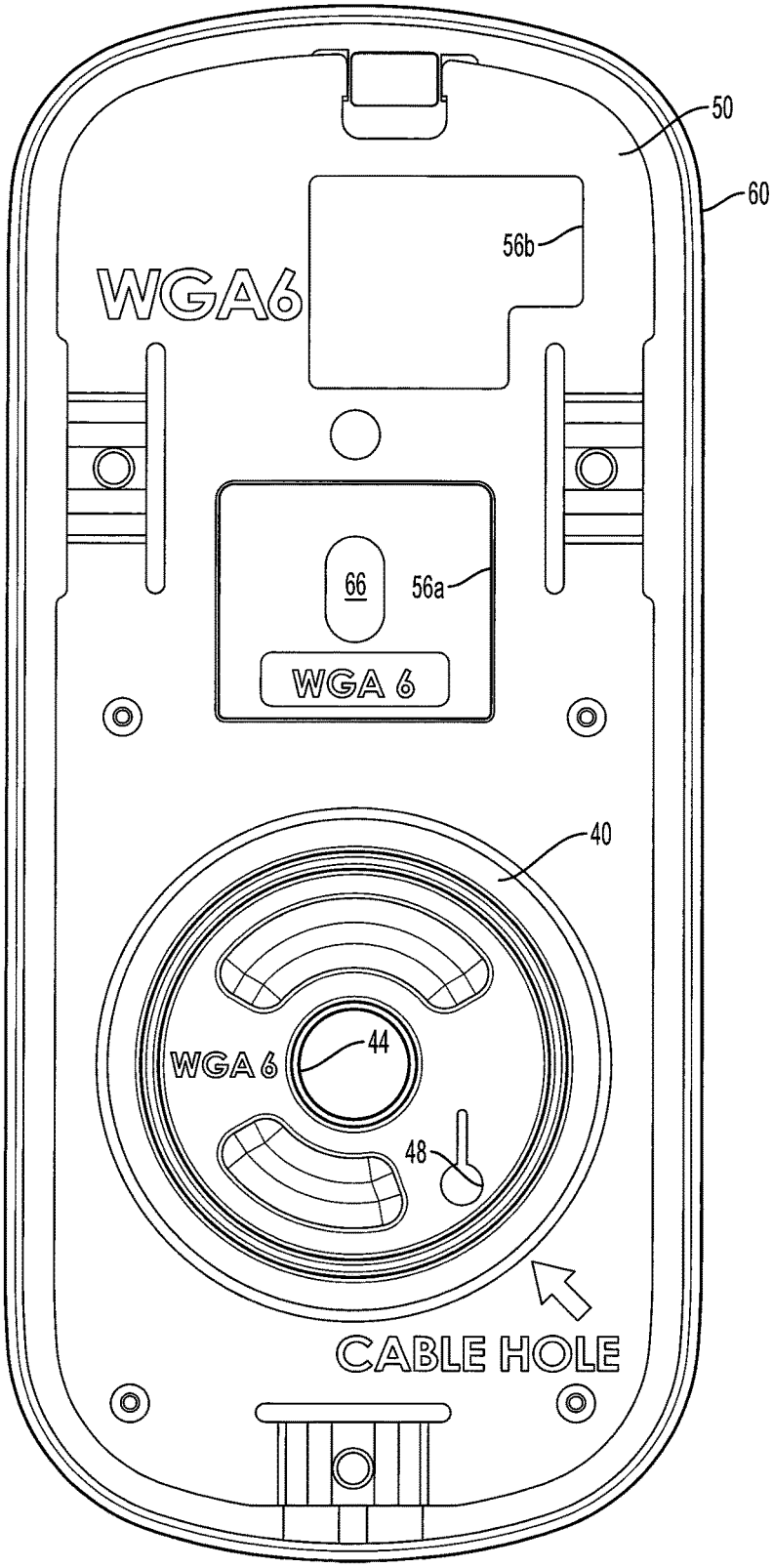
FIG. 14 is a frontal view of the assembled rear portion, bracket, and sealing plug of the electronic lock housing of FIG. 1.
Figure 15:
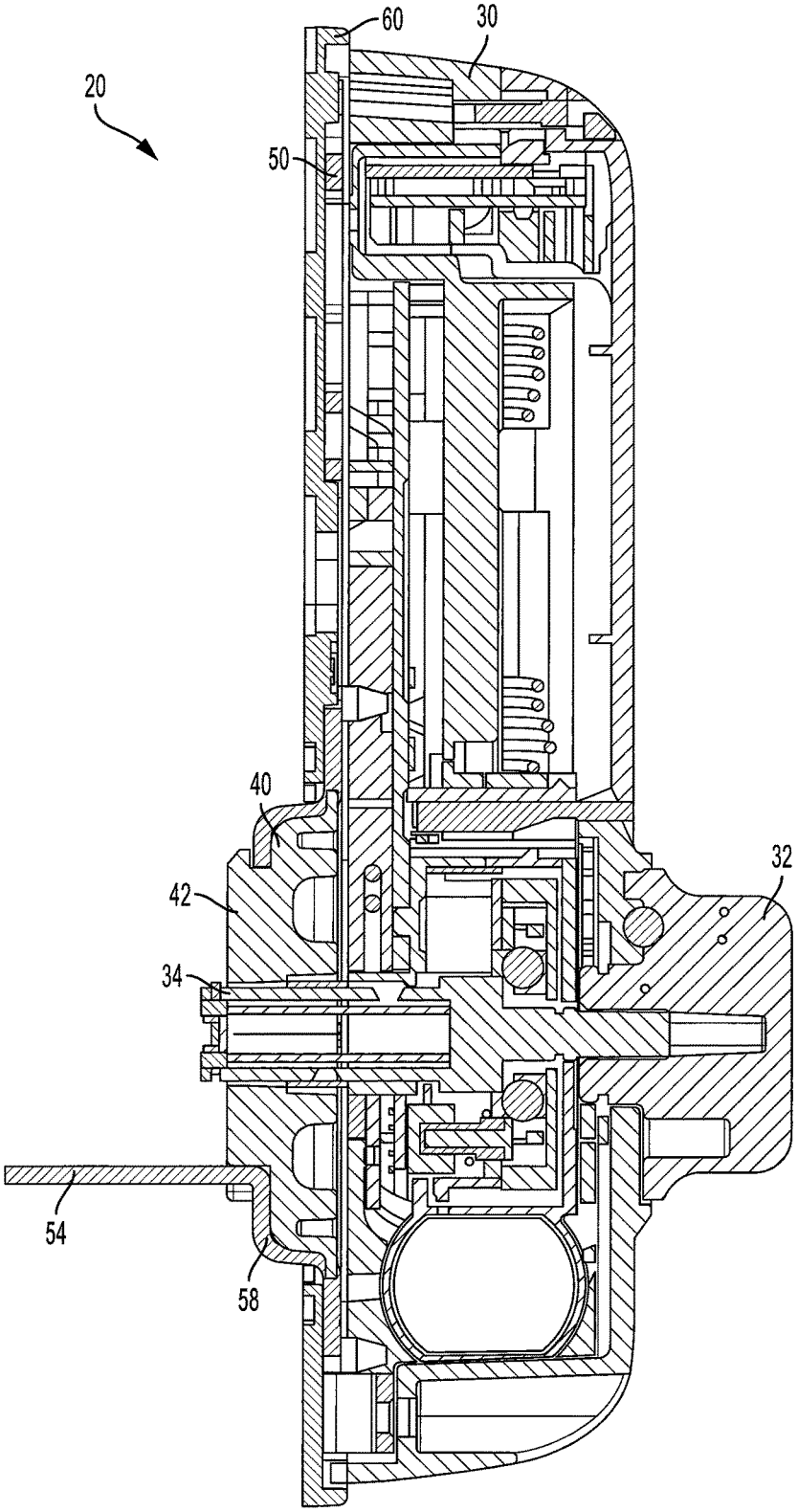
FIG. 15 is a side cross-sectional view of the electronic lock housing of FIG. 1.

Full assembly of the electronic lock housing 20 includes affixing bracket 50 within back portion 60 so that the edges of bracket 50 and back portion 60 are in substantial alignment (see FIG. 14). Once bracket 50 and back portion 60 are assembled, they are placed on the inside surface of door 80 with the outside surface of back portion 60 contacting the inside surface of door 80. When properly placed, the back central opening 62 of back portion 60 and door opening 82 are in axial alignment. The bracket 50 and back portion 60 assembly is then secured in place against the inside surface of door 80 with at least one fastener extending through bracket 50, back portion 60, and surface of door 80. Plug 40 is then snapped in place within the bracket 50 protuberance 58 so that tabs 46 along the periphery of projection 42 bear against the edge of bracket opening 52, creating an air-tight connection. Housing front portion 30 is then secured over the bracket 50 with fasteners and/or clips. The edges of housing front portion 30 are in substantial alignment with the edges of bracket 50 and back portion 60, with the edges of back portion 60 contacting the outside perimeter of the housing front portion 30 edges to create an air-tight seal, and with the edges of bracket 50 adjacent the inside perimeter of the housing front portion 30 edges. The drive bar collar 34 located on the back side of housing front portion 30 should rest within and through plug central opening 44, bracket central opening 52, back central opening 62, and door drive bar opening 82, respectively. Batteries 23 may be inserted into battery holder 22 after housing front portion 30 is completely secured to the bracket 50 and back portion 60 assembly, which in turn is completely secured to the door 80. The battery shell 24 may be snapped in place or fastened to the housing front portion 30 over the battery holder 22 once the batteries 23 are installed.

Thus, the present invention employs one or more of: 1) a plug to block humid air outside the door from flowing into the electromechanical or electronic lock body inside the door, 2) primary channels in the baseplate/gasket of the electromechanical or electronic lock body to allow the humid air to flow into the room inside the door instead of into the lock body and/or, 3) a second separate set of channels in the baseplate/gasket of the electromechanical or electronic lock body that allow the lock body to "breath" room air. The present invention provides the aforedescribed apparatus and methods to reduce condensation problems experienced on electromechanical locks, and to otherwise seal the contents of the electronic lock.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An electronic lock housing for an inside of a door having an opening therethrough for passage of a drive bar from the electronic lock housing to a lock on the door comprising:

a housing interior portion for receiving electronic components for the door lock;

a housing back portion having a back opening for securing on the inside of the door over the door opening, the housing back opening being between the housing interior portion and the door;

one or more channels in the housing back portion, extending between the housing back opening and an exterior of the housing, to permit air from the outside of the door to flow through the door opening and the housing back opening to the inside of the door, without passing through the housing interior portion.

2. The electronic lock housing of claim 1 wherein the housing back portion comprises a gasket between the door and the housing, and wherein the one or more channels are disposed in the housing back portion gasket.

3. The electronic lock housing of claim 1 wherein the one or more channels comprise slots in the housing back portion.

4. The electronic lock housing of claim 1 wherein the housing back portion comprises a gasket between the door and the housing, and wherein the one or more channels comprise slots in the housing back portion gasket.

5. The electronic lock housing of claim 1 further including a plug aligned with the housing back opening for restricting flow of air from the outside of the door through the door opening and into the housing interior portion.

6. The electronic lock housing of claim 5 wherein the plug includes an opening for passage of the drive bar from the housing interior portion to the door lock and, an opening for a cable from the housing interior portion to the door lock.

7. The electronic lock housing of claim 6 wherein the plug opening is configured to mate with a collar around the drive bar in the housing interior portion.

8. The electronic lock housing of claim 1 further including one or more secondary channels in the housing back portion to permit air from the inside of the door to flow into the housing interior portion.

9. The electronic lock housing of claim 8 wherein the one or more secondary channels comprise slots in the housing back portion.

10. The electronic lock housing of claim 8 wherein the housing back portion comprises a gasket between the door and the housing, and wherein the one or more secondary channels comprise slots in the housing back portion gasket to permit air from the inside of the door to flow into the housing interior portion.

11. An electronic lock housing for an inside of a door having an opening therethrough for passage of a drive bar from the electronic lock housing to a lock on the door comprising:

a housing interior portion for receiving electronic components for the door lock;

a housing back portion having a back opening for securing on the inside of the door over the door opening, the housing back opening being between the housing interior portion and the door;

a plug aligned with the housing back opening for restricting flow of air from the outside of the door through the door opening and into the housing interior portion.

12. An electronic lock housing for an inside of a door having an opening therethrough for passage of a drive bar from the electronic lock housing to a lock on the door comprising:

a housing interior portion for receiving electronic components for the door lock;

a housing back portion for securing on the inside of the door over the door opening; and one or more secondary channels in the housing back portion to permit air from the inside of the door to flow into the housing interior portion.

13. A method of sealing an electronic lock housing for a door comprising:

providing an electronic lock housing having a housing interior portion for receiving electronic components for a door lock, a housing back portion having a back opening for securing on the inside of the door over a door opening, the housing back opening having one or more channels extending between the housing back opening and an exterior of the housing;

mounting the electronic lock housing with the housing back portion on the inside of the door and over the door opening; and permitting air from the outside of the door to flow through the door opening, the housing back opening and the one or more channels to the inside of the door, without passing through the housing interior portion.

14. The method of claim 13 further including aligning a plug with the housing back opening of the electronic lock housing to restrict flow of air from the outside of the door through the door opening and into the housing interior portion.

15. The method of claim 13 further including providing in the electronic lock housing one or more secondary channels in the housing back portion to permit air from the inside of the door to flow into the housing interior portion.

16. The method of claim 13 wherein the door opening permits passage of a drive bar from the electronic lock housing to a lock on the door, and wherein the method reduces condensation of humid outside air in the electronic lock housing.

17. A method of sealing an electronic lock housing for a door comprising:

providing an electronic lock housing having a housing interior portion for receiving electronic components for a door lock, a housing back portion having a back opening for securing on the inside of the door over a door opening, the housing back opening being between the housing interior portion and the door, and a plug aligned with the housing back opening;

mounting the electronic lock housing with the housing back portion on the inside of the door and over the door opening; and restricting flow of air from the outside of the door through the door opening by the plug aligned with the housing back opening.

18. The method of claim 17 further providing one or more channels extending between the housing back opening and an exterior of the housing, the one or more channels permitting air from the outside of the door to flow through the door opening, the housing back opening and the one or more channels to the inside of the door, without passing through the housing interior portion.

19. The method of claim 17 further including providing one or more secondary channels in the housing back portion to permit air from the inside of the door to flow into the housing interior portion.

20. The method of claim 17 wherein the door opening permits passage of a drive bar from the electronic lock housing to a lock on the door, and wherein the method reduces condensation of humid outside air in the electronic lock housing.

21. A method of sealing an electronic lock housing for a door comprising:

providing an electronic lock housing having a housing interior portion for receiving electronic components for a door lock, a housing back portion having a back opening for securing on the inside of the door over a door opening, the housing back opening being between the housing interior portion and the door, and one or more secondary channels in the housing back portion to permit air from the inside of the door to flow into the housing interior portion;

mounting the electronic lock housing with the housing back portion on the inside of the door and over the door opening; and permitting air from the inside of the door to flow into the housing interior portion.

22. The method of claim 21 further providing one or more channels extending between the housing back opening and an exterior of the housing, the one or more channels permitting air from the outside of the door to flow through the door opening, the housing back opening and the one or more channels to the inside of the door, without passing through the housing interior portion.

23. The method of claim 21 further including aligning a plug with the housing back opening to restrict flow of air from the outside of the door through the door opening and into the housing interior portion.

24. The method of claim 21 wherein the door opening permits passage of a drive bar from the electronic lock housing to a lock on the door, and wherein the method reduces condensation of humid outside air in the electronic lock housing.

* * * * *